United States Patent [19]

Haley

[11] Patent Number: 4,700,552

[45] Date of Patent: Oct. 20, 1987

[54] CONVERTIBLE EARRING CONSTRUCTION

[75] Inventor: Richard J. Haley, Lincoln, R.I.

[73] Assignee: Quality Jewelry, Inc., Pawtucket, R.I.

[21] Appl. No.: 900,312

[22] Filed: Aug. 25, 1986

[51] Int. Cl.[4] ..... A44C 7/00

[52] U.S. Cl. ..... 63/12; 63/14 D

[58] Field of Search ..... 63/12, 13, 14 R, 14 D, 63/14 E, 14 A, 14 G, 14 F, 14 C, 14 B; D11/40, 69

[56] References Cited

U.S. PATENT DOCUMENTS

| | | | |
|---|---|---|---|
| 263,755 | 9/1882 | Braverman | 63/12 |
| 687,446 | 11/1901 | Washburn | 63/14 C |
| 2,519,518 | 8/1950 | Victor | 63/14 E |
| 3,122,007 | 2/1964 | Horland | 63/1 R |
| 4,003,216 | 1/1977 | Cecere | 63/12 |
| 4,218,894 | 8/1980 | Tropea | 63/13 |
| 4,655,055 | 4/1987 | Moody | 63/12 |

*Primary Examiner*—Richard J. Johnson

*Attorney, Agent, or Firm*—Salter & Michaelson

[57] ABSTRACT

A convertible earring construction comprises a clamping element of substantially U-shaped configuration which is securable on a nonpierced earlobe, a clutch element which is secured on the clamping element at the bottom or base end thereof and a pierced earring element of conventional construction which is receivable in the clutch element. The clutch element is secured on the clamping element so that it faces outwardly in substantially perpendicular relation to the plane of an earlobe when the clamping element is secured thereon, and therefore the pierced earring element is securable in the clutch element so that the decorative portion of the pierced earring element faces outwardly from an earlobe without modifying or deforming the pierced earring element.

6 Claims, 4 Drawing Figures

CONVERTIBLE EARRING CONSTRUCTION

BACKGROUND AND SUMMARY OF THE INVENTION

The instant invention relates to ornamental jewelry and more particularly to a convertible earring construction which is adapted to be alternatively worn as a pierced earring or as a nonpierced earring.

Heretofore, it has generally only been possible for pierced earrings of the type which include a post which is adapted to be received in an aperture in an earlobe of a wearer to be worn by persons having pierced ears. In this connection, although it has been possible to structurally modify pierced earrings of this type to enable them to be worn by persons having nonpierced ears, the modifications which have been required have generally prevented them from thereafter being worn as pierced earrings. Hence, as a practical matter, many of the styles of earrings which have only been made in pierced earring constructions have been unavailable to those persons having nonpierced ears. Recently, however, clamping devices have been developed in an attempt to adapt pierced earrings for use on nonpierced earlobes. These clamping devices, which represent the closest prior art to the subject invention of which the applicant is aware, have comprised generally U-shaped clamping portions which are adapted to be received on the nonpierced earlobes of wearers and tubular cluch elements which are secured in substantially coextensive relation on the outwardly facing legs of the clamping portions. However, since the clutch elements of devices of this type are oriented in planes which are substantially parallel to the earlobes of wearers when the devices are secured thereon, it has been necessary to bend the posts of pierced earrings at angles of approximately 90° in order for them to be assembled with the clutch elements so that the decorative ornaments attached to the posts thereof face outwardly from the earlobes. Accordingly, it has been necessary to permanently deform pierced earrings in order to adapt them to be worn with clamping devices of this type, so that thereafter it has not been possible for the earrings to be worn as pierced earrings. Other earring constructions and jewelry items which are believed to be less pertinent and of more general interest to the subject invention are disclosed in the U.S. patents to Mill et al No. 788,770; Jellinek No. 2,274,269; Pujol No. 2,285,051; Battiste No. 2,501,754; Cuccioli No. 2,601,433; Bangs et al No. 2,863,306; Horland No. 3,122,007; and Boening No. 4,276,757.

The instant invention provides a highly effective convertible earring construction comprising a post-type pierced earring and a clamping device for securing the pierced earring on a nonpierced earlobe of a wearer without structurally modifying or deforming the earring. Hence, the pierced earring portion of the convertible earring of the subject invention can alternatively be worn in combination with the clamping device on a nonpierced earlobe or without the clamping device on a pierced earlobe. More specifically, the convertible earring construction of the instant invention comprises a clamping element of a substantially U-shaped configuration which is adapted to be received and secured on an earlobe of a wearer, a clutch element which is secured to the base or bottom end portion of the U-shaped clamping element so that it faces outwardly therefrom in a substantially horizontal disposition, and a pierced earring element of conventional construction which is receivable in the clutch element so that a decorative portion of the earring element faces outwardly from the earlobe. The clutch element preferably comprises a bullet-type clutch, and one embodiment of the convertible earring construction further comprises a second decorative portion which is secured on the outwardly facing leg of the U-shaped element and positioned thereon so that it is disposed above the first decorative portion when the earring construction is secured on the earlobe. In a second embodiment of the convertible earring construction, the first decorative portion is of enlarged dimension, and it is positioned on the post of the earring element so that it conceals the outwardly facing leg of the U-shaped element when the earring construction is received on the earlobe. Further, the first decorative portion preferably has a rearwardly facing surface of concave configuration, and at least a portion of the outwardly facing leg of the U-shaped clamping element is receivable in the rear portion of the first decorative portion to substantially prevent relative rotation between the clamping element and the earring element when the earring is secured on an earlobe.

Accordingly, it is a primary object of the instant invention to provide a convertible earring construction which is adaptable for use on both pierced and nonpierced ears.

Another object of the instant invention is to provide a convertible earring construction comprising a pierced earring element of conventional configuration and a clamping element for securing the pierced earring element on a nonpierced earlobe without altering of the pierced earring element.

A still further object of the instant invention is to provide a convertible earring construction comprising a U-shaped clamping element which is securable on a nonpierced earlobe of a wearer and a clutch element which is secured in outwardly facing relation to the base or bottom end portion of the U-shaped clamping element for receiving the post of a pierced earring.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
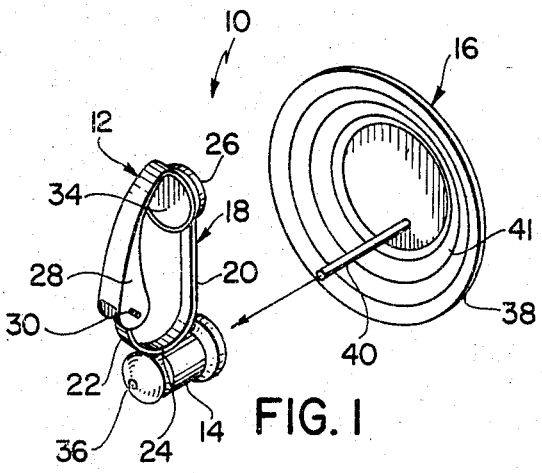
FIG. 1 is an exploded perspective view of the convertible earring construction of the instant invention.
Figure 2:
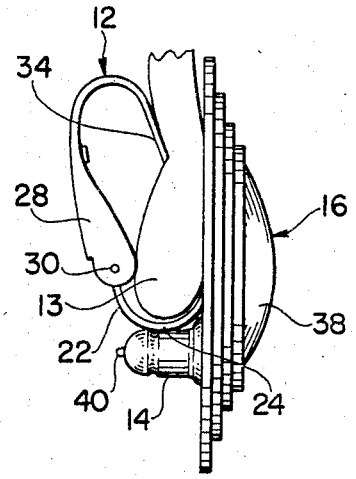
FIG. 2 is a side elevational view of the earring construction on an earlobe of a wearer.
Figure 3:
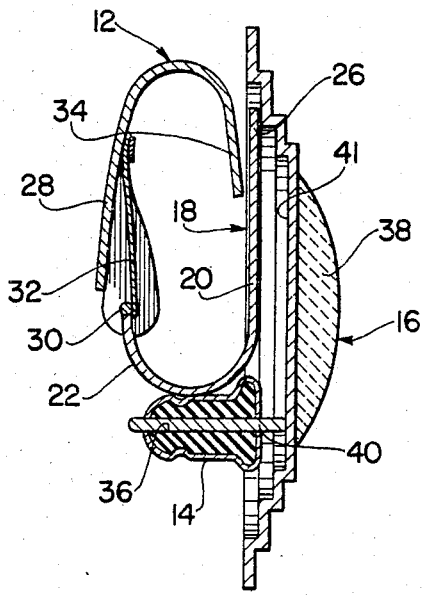
FIG. 3 is an enlarged side sectional view of the earring construction per se.

Referring now to the drawing, a first embodiment of the earring construction of the instant invention is illustrated in FIGS. 1 through 3 and generally indicated at 10. The earring construction 10 comprises a clamping element 12 which is securable on an earlobe 13 of a wearer, a clutch element 14 which is secured to the clamping element 12 at the base or bottom end thereof, and a pierced earring element generally indicated at 16. The clamping element 12 is securable on the earlobe 13 so that the clutch element 14 faces outwardly therefrom in a substantially horizontal disposition adjacent the lower periphery of the earlobe 13. The pierced earring element 16 is receivable in assembled relation with the clutch element 14 so that it faces outwardly from the clutch element 14 and the clamping element 12 and hence is displayed in outwardly facing relation adjacent the earlobe 13 when the clamping element 12 is secured thereon.

The clamping element 12 comprises a U-shaped main portion generally indicated at 18 having a forwardly facing first leg 20, a rearwardly facing second leg 22, and a lower or base portion 24 which interconnects the legs 20 and 22. Formed at the upper end of the forwardly facing first leg 20 is a substantially circular disc 26 which is engageable with the front portion of an earlobe, and pivotally attached to the upper end of the rearwardly facing second leg 22 is a resilient clamping arm 28. The clamping arm 28 is attached to the second leg 22 so that it is resiliently pivotable rearwardly or outwardly with respect to the first leg 20. More specifically, the clamping arm 28 is pivotally attached to the rear leg 22 by a pivot pin 30, and a leaf spring 32 biases the clamping arm 28 forwardly toward the first leg 20. The clamping arm 28 extends generally upwardly from the upper end of the rearwardly facing second leg 22 and then forwardly and downwardly, terminating in a clamping disc 34 which is engageable with the rear side of an earlobe for securing the clamping element 12 thereon. In this connection, the spring 22 biases the clamping arm 28 forwardly toward the first leg 20, and hence when the clamping element 12 is received on the earlobe 13, the clamping discs 34 and 26 embrace the earlobe 13 to effectively secure the clamping element 12 thereon in a conventional manner, as illustrated most clearly in FIG. 2.

The clutch element 14 preferably comprises a conventional bullet-type clutch having an aperture 36 therein for receiving the post of a pierced earring. The clutch element 14 is secured to the base portion 24 of the clamping element 12 so that when the clamping element is received on an earlobe such as the earlobe 13, the clutch element 14 faces outwardly in a substantially horizontal disposition or substantially perpendicular to the plane of the earlobe 13 for receiving the post of a pierced earring element 16.

The pierced earring element 16 is of conventional construction, and it comprises a decorative portion 38 and a post 40 which extends rearwardly therefrom and is dimensioned to be received in the aperture 36 in the clutch element 14. The decorative element 38 is preferably constructed so that it has a rearwardly facing concave surface 41 thereon, and it is preferably dimensioned and configured so that when the post 40 is received in assembled relation with the clutch element 14, the decorative portion 38 substantially conceals the forwardly facing first leg 20 of the clamping element 12. In addition, the clamping element 12 and the decorative element 13 are preferably dimensioned and configured so that when the pierced earring element 16 is received in assembled relation with the clutch element 14 and the clamping element 12 it is mounted on an earlobe such as the earlobe 13. In the mounted position the forwardly facing first leg 20 is at least partially received in the rear portion of the decorative portion 38 so that it is engageable with the concave rearwardly facing surface 41 thereof to substantially prevent the decorative element 38 from rotating about the axis of the post 40.

Figure 4:
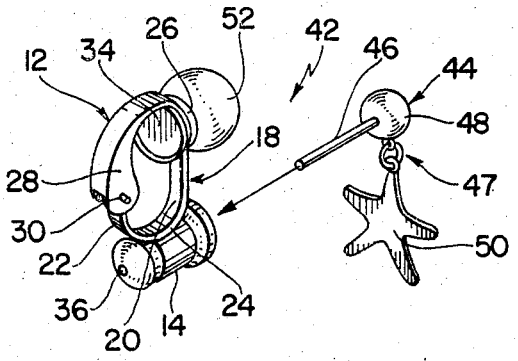
FIG. 4 is an exploded perspective view of a second embodiment of the earring construction.

A second embodiment of the convertible earring construction of the instant invention is illustrated in FIG. 4 and generally indicated at 42 and comprises a clamping element 12, a clutch element 14, and a pierced earring element 44. The pierced earring element 44 comprises a post 46 and a first decorative element 47 including a decorative spherical ball 48 which is secured to the post 46, and a decorative star-shaped element 50 which is suspended from the ball 48 by a link. The earring 42 further comprises a second decorative element 52 which is secured on the forwardly facing side of the clamping disc 26 on the first leg 20 of the clamping element 12. The first decorative element 47 and the second decorative element 52 are dimensioned and configured so that when the pierced earring element 44 is assembled with the clutch element 14, the second decorative element 52 is displayed above the first decorative element 47 on the outwardly facing side of the earring construction 42.

It is seen, therefore, that the instant invention provides an effective earring construction which is convertible for alternatively securing it on a pierced earlobe or on a nonpierced earlobe without permanently modifying the earring element portion of the earring construction. Most specifically, the clamping element 12 is mountable on a nonpierced earlobe such as the earlobe 13 for securing either the pierced earring element 16 or the pierced earring element 44 thereto. Alternatively, the pierced earring element 16 or the pierced earring element 44 can be installed on a pierced earlobe in a conventional manner, and a clutch of conventional construction can be utilized for retaining the earring element 16 or the earring element 44 on the pierced earlobe. Since the clutch element 14 is positioned in a substantially horizontal disposition when the clamping element 12 is secured on an earlobe, such as the earlobe 13, the post 40 does not need to be bent or deformed to enable it to be secured on a nonpierced earlobe. Hence, the pierced earring element 16 can still be used by persons having pierced ears. Accordingly, it is seen that the convertible earring construction of the instant invention represents a significant improvement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible earring construction comprising a clamping element of substantially U-shaped configuration which is adapted to be received and secured on an earlobe of a wearer; a clutch element secured to the base of said U-shaped clamping element so that when said clamping element is received on said earlobe said clutch element faces outwardly in substantially perpendicular relation to the plane of said earlobe; and a pierced earring element comprising a post which is releasably receivable in said clutch element when said clamping element is secured on said earlobe, and a first decorative portion joined to said post and being displayed in outwardly facing relation adjacent said earlobe when said clamping element is received on said earlobe and said post is received in said clutch element.

2. The convertible earring construction of claim 1 further comprising a second decorative portion secured on the outwardly facing leg of said U-shaped clamping element and positioned thereon so that it is disposed above said first decorative portion when said earring construction is secured on said earlobe.

3. In the convertible earring construction of claim 1, said clutch element further characterized as a bullet-type clutch.

4. In the convertible earring construction of claim 1, said first decorative portion being of enlarged dimension and concealing the outwardly facing leg of said U-shaped clamping element when said earring construction is received on said earlobe.

5. In the convertible earring construction of claim 4, said first decorative portion having a rearwardly facing surface of concave configuration, said outwardly facing leg being at least partially receivable in the rear portion of said first decorative portion.

6. In the convertible earring construction of claim 5, said first decorative portion and the forwardly facing leg of said clamping portion being configured so that said forwardly facing leg is engageable in the said first decorative portion to substantially prevent rotation thereof.

* * * * *